US005158242A

United States Patent [19]

Honegger

[11] Patent Number: 5,158,242

[45] Date of Patent: Oct. 27, 1992

[54] APPARATUS FOR THE UNWINDING OF FLEXIBLE SHEET-LIKE STRUCTURES FROM A ROLL

[75] Inventor: Werner Honegger, Tann Ruti, Switzerland

[73] Assignee: Ferag, AG, Hinwil, Switzerland

[21] Appl. No.: 672,172

[22] Filed: Mar. 19, 1991

[30] Foreign Application Priority Data

Mar. 23, 1990 [CH] Switzerland ..... 00 971/90

[51] Int. Cl.[5] ..... B65H 63/08

[52] U.S. Cl. ..... 242/59

[58] Field of Search ..... 242/55, 59, 67.3 R; 53/118; 271/216, 214

[56] References Cited

U.S. PATENT DOCUMENTS

| | | | |
|---|---|---|---|
| 3,025,014 | 3/1962 | Casey | 242/67 |
| 4,438,618 | 3/1984 | Honegger . | |
| 4,532,750 | 8/1985 | Meier | 53/118 |
| 4,550,883 | 11/1985 | Boss . | |
| 4,587,790 | 5/1986 | Muller . | |
| 4,589,603 | 5/1986 | Muller . | |
| 4,597,541 | 7/1986 | Leu | 242/55 |
| 4,651,941 | 3/1987 | Muller . | |
| 4,775,111 | 10/1988 | Kalin . | |
| 4,795,105 | 1/1989 | Frei | 242/59 |
| 4,898,336 | 2/1990 | Reist | 242/59 |
| 4,901,935 | 2/1990 | Reist | 242/68.7 |
| 4,995,563 | 2/1991 | Kalin | 242/59 |

FOREIGN PATENT DOCUMENTS

| | | |
|---|---|---|
| 0310784 | 8/1988 | European Pat. Off. . |
| 2205476 | 2/1972 | Fed. Rep. of Germany . |

*Primary Examiner*—Daniel P. Stodola
*Assistant Examiner*—John Rollins
*Attorney, Agent, or Firm*—Willian Brinks Olds Hofer Gilsion & Lione

[57] ABSTRACT

An unwinding apparatus has a vertically adjustable bearing arrangement for bearing a winding unit. A winding core carries a roll of printing products, wound up together with a winding band. For unwinding the printing products and circumferential driving of the winding unit, the latter is lowered onto round bands, which can be driven in arrow direction A. A band reel thereby comes into contact with the circumference of the roll at the winding band. The band reel is arranged to seize and take up the outer end of the winding band. As a result, it is no longer necessary to release the winding band end from the roll and fasten it to the band reel manually.

16 Claims, 5 Drawing Sheets

APPARATUS FOR THE UNWINDING OF FLEXIBLE SHEET-LIKE STRUCTURES FROM A ROLL

BACKGROUND OF THE INVENTION

The present invention relates to an apparatus for the unwinding of flexible sheet-like structures, in particular printing products in imbricated formation, wound up together with a winding band onto a winding core to form a roll, according to the preamble of claim 1.

An unwinding apparatus of this type is known for example from EP-A1 0 292 891, which corresponds to U.S. Pat. No. 4,901,935. This apparatus has two mutually parallel and spaced apart, endless carrying bands, which are led around rollers mounted at the same height on a rack. For the unwinding of printing products wound-up in imbricated formation together with a winding band onto a winding core to form a roll from said roll, the winding unit formed by the winding core and the roll is set down onto the effective carrying sides of the carrying bands. The roll thereby rests with its circumference on the carrying bands and is wrapped partly around by the latter for driving the winding unit. The rollers around which the two carrying bands are led, at the end of the effective conveying sides seen in the unwinding sense of the printing products, are seated in a rotationally fixed manner on a common shaft, which is coupled to a drive motor. A band reel, which is likewise connected to the drive motor, via a friction clutch, is seated freely rotatably on the shaft between these two rollers. Once the winding unit has been set down onto the carrying bands, the initial region of the winding band, which is lashed to the roll, is manually released, brought to the band reel and connected to it. Since the band reel is driven faster, via the friction clutch, than the carrying bands during the unwinding operation, the winding band is constantly kept under tension. As soon as all the printing products have been unwound from the roll, the end of the winding band on the winding core side is released from the winding core and the latter is lifted off the carrying bands. The full band reel must then be exchanged for an empty one in order to be able to take up the winding band of the next roll to be unwound. Consequently, a considerable amount of manual work is necessary, to release the lashed winding band and to fasten the winding band end onto the band reel.

In addition, an apparatus for the winding-up and unwinding of printing products together with a winding band to form a roll or from a roll is known from EP-A1 0 281 790, which corresponds to U.S. Pat. No. 4,898,336. This apparatus has a carriage which is displaceable in the vertical direction on a rack and on which a bearing arrangement is provided for the winding core carrying the roll. The bearing arrangement has a drive motor, in order to drive on the winding core side the winding unit set down onto the bearing arrangement. Underneath the bearing arrangement there is provided a belt conveyor which has two loose conveyor belts spaced laterally apart, and which is mounted in the manner of a rocker and is prestressed against the roll. The winding bands are driven solely by the roll, due to wrapping partly around it. Mounted freely rotatably on the rocker of the belt conveyor is a deflection roller, around which the winding band coming from the roll is led and from which the winding band runs to a band reel mounted fixedly on the rack and driven via a drive motor. For unwinding, the winding unit with the winding core is set down onto the bearing arrangement, the carriage being located in its uppermost end position. Thereafter, the carriage is lowered to the extent that the roll comes into contact with the conveyor belts of the belt conveyor and the belt conveyor is thereby pivoted into a lower end position. Then the winding band end lashed to the roll is released and brought around the deflection roller to the band reel and fastened there. During the unwinding operation, the winding unit is driven via the drive of the bearing arrangement in the unwinding sense and the belt conveyor, due to its bearing against the circumference of the roll, for conveying away the unwound printing products also runs at the circumferential speed of the winding unit. The winding band is kept under tension by the drive of the band reel. As soon as the rocker of the band conveyor has pivoted upward by a certain amount during unwinding, due to the reduction in diameter of the roll, the carriage is lowered further, until the belt conveyor is again located in its lower end position. In the case of this known apparatus as well, the work in detaching the winding band from the roll and fastening the winding band end to the band reel involves considerable effort. Furthermore, the known apparatus is complicated in construction and complex in terms of its drive.

In addition, a touch-and-close fastener for a winding band is described in EP-A1 0 310 784, which corresponds to U.S. patent application Ser. No. 07/585,033, now U.S. Pat. No. 5,081,748. The winding band is wound-up together with printing products on a roll and has at its outer end region, on the side facing the roll, a hook pile, which interacts with a loop pile, which is provided on the outside of the winding band. The loop pile extends over a certain length of the winding band, so that the hook pile always bears against a region of the loop pile, irrespective of the diameter of the roll. The hook pile and loop pile flank a spacer, the thickness of which at most corresponds to the height of the assigned pile. To open the touch-and-close fastener, a trowel-like tool is inserted from the end of the winding band between the spacer assigned to the hook pile and the spacer assigned to the loop pile.

Swiss Patent Specification 652,379 and the corresponding U.S. Pat. No. 4,532,750 disclose an apparatus for the winding up of printing products in imbricated formation onto a winding core, in which, before winding-up, the winding band is drawn off a supply reel provided inside the winding core and is wound onto a band reel. To detach the winding band from the supply reel, there is provided inside the winding core a pin which is prestressed against the supply reel and, when the supply reel rotates, by means of a separate drive, pierces between the winding band end and the supply reel. The detached winding band end is led out from the winding core through an opening, seized by a pair of advancing rollers and led by a guide running along a rocker, for feeding the printing products to the roll, and by means of a further rocker to the circumference of the band reel. When a number of windings of the winding band have been wound onto the band reel, the separate drive is pivoted together with the driven roller of the pair of advancing rollers out of the area of the winding core. If the winding band has a touch-and-close fastener in order to keep the winding band on the supply reel, it is provided away from the winding band end, in order that the pin can detach the winding band end and the pair of advancing rollers can seize the winding band before the touch-and-close fastener is to be opened. Furthermore, a similarly designed detaching device, arranged on the rocker for feeding the printing products to the winding core, for detaching the winding band end from a winding band supply arranged in a covered circumferential groove of the winding core is known from EP-A1 0 280 949 and the corresponding U.S. Pat. No. 4,795,105. The band end detached from the next winding layer of the winding band supply is deflected and fed to a band reel remote from the rocker.

It is an object of the present invention to provide an apparatus of the generic type described above which is extremely easy to operate and simple in construction.

SUMMARY OF THE INVENTION

According to this invention, the band reel bears against the circumference of the roll at the winding band in order to seize and take over the outer band end automatically when the winding unit rotates in the unwinding sense. Consequently, no manual effort at all is necessary any longer in order, if appropriate, to lead the winding band end around deflection rollers to the band reel and to fasten it to the latter.

Preferred embodiments of the present invention are specified in the dependant claims.

BRIEF DESCRIPTION OF THE DRAWINGS

The present invention is explained in further detail with reference to an exemplary embodiment represented in the purely diagrammatic figures in which.

DETAILED DESCRIPTION OF THE PRESENTLY PREFERRED EMBODIMENTS

Figure 3:
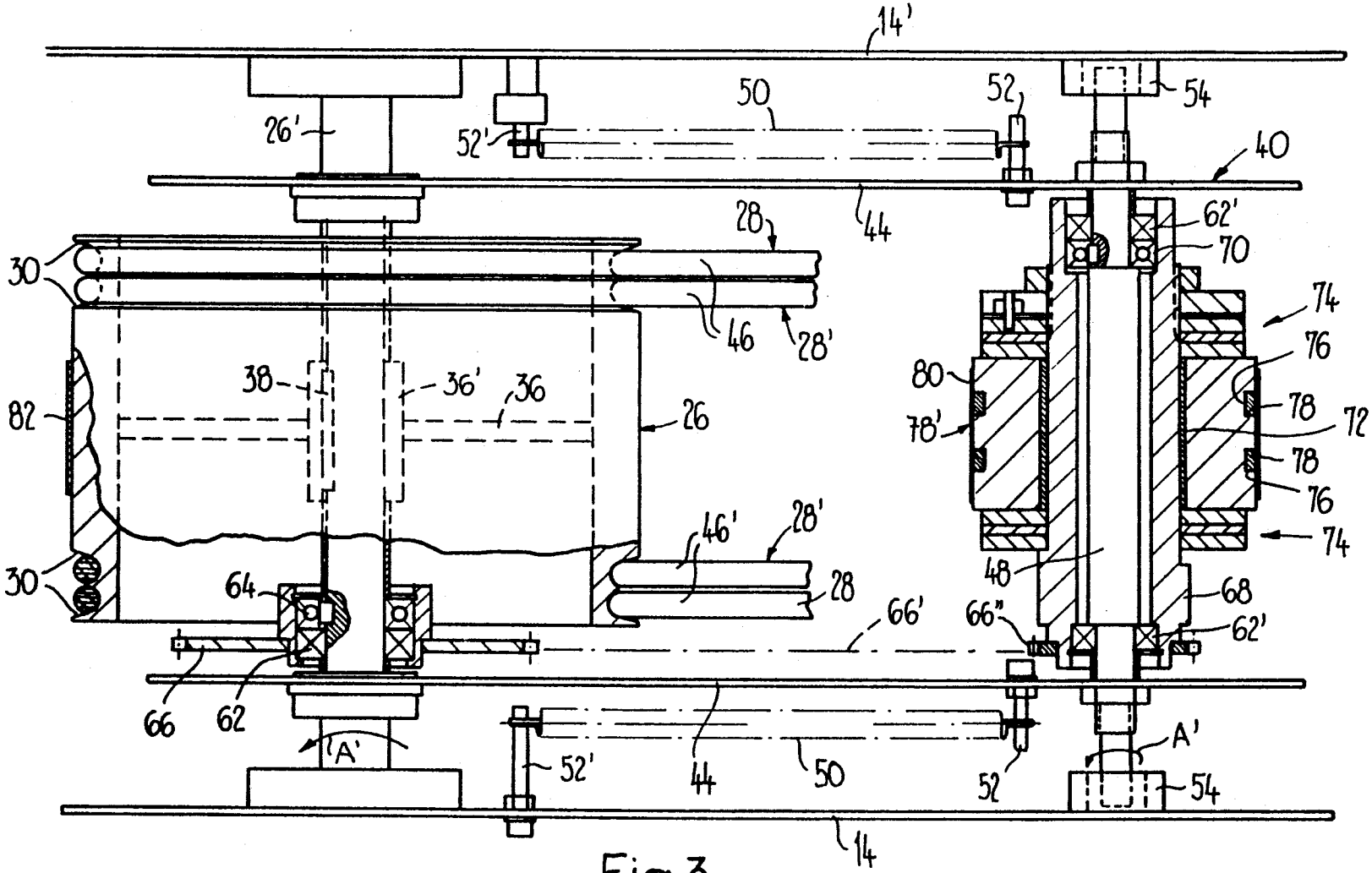
FIG. 3 shows a part of the unwinding apparatus of FIG. 1 in plan view, enlarged and partly sectioned.

The unwinding apparatus 10 represented in the drawings has a base 12, supported on the ground, with two lateral bearing plates 14, 14', on which there is anchored a lateral, upright guide column 16, provided outside the bearing plate 14' and connected to it. A bearing arrangement 17 for a winding unit 18 is mounted vertically adjustably on the guide column 16. The winding unit 18 comprises a winding core 19, removably mounted on the bearing arrangement 17, and a roll 20 of printing products, such as periodicals, newspapers and the like, wound-up in imbricated formation together with a tensioned winding band 21 on the winding core 19. Printing products unwound from the roll 20 are denoted in FIG. 1 by 22. Provided underneath the bearing arrangement 17 is a conveyor belt arrangement 23, which has four endless round bands 28, 28' of elastomeric material, led around two fixed rollers 24, 26. The rollers 24, 26 each have on their axial end regions two adjacently arranged circumferential grooves 30, in which the round bands, 28, 28' are guided. The inner lying round bands 28' are consequently spaced apart. The depth of the circumferential grooves 30 corresponds approximately to the diameter of the round bands 28, 28' (see in particular FIG. 3).

The roller 24 positioned ahead of the guide column 16, seen in arrow direction A, which corresponds to the direction of circulation of the round bands 28, 28' during unwinding of the roll 20, is seated in a rotationally fixed manner on a shaft 24', which is mounted freely rotatably on the two bearing plates 14, 14' and is effectively connected to a drive motor 34 via a reversing gear 32. The other roller 26, positioned behind the guide column 16, seen in arrow direction A, is seated in a rotationally fixed manner on a shaft 26', likewise mounted freely rotatably on the two bearing plates, 14, 14'. The roller 26 is arranged underneath the roller 24 in a vertical direction, so that an imaginary tangent applied to the two rollers 24, 26 from above runs obliquely downwards from the roller 24 to the roller 26 (see also FIG. 4). The roller 26 of a larger diameter than the roller 24 is designed in the form of a hollow cylinder and has in the central region a supporting disk 36 with a hub 36'. The hub 36' is seated in a rotationally fixed manner on the shaft 26' via a generally known keying 38. When the round bands 28, 28' circulate in arrow direction A, the roller 26 rotates and consequently so does the shaft 26' in direction A'.

On the shaft 26' there is also pivotally mounted a rocker 40 for a band reel 42. The rocker 40 has two rocker plates 44, which are each mounted in the region between the roller 26 and the bearing plates 14, 14' on the shaft 26', freely rotatably with respect to the latter. Seen in the vertical direction, the rocker extends between the upper and lower sides 46, 46' of the round bands 28, 28' into the area of the guide column 16, where there is provided, running parallel to the shaft 26', a shank 48, which penetrates the two rocker plates 44 and is fastened in a rotationally fixed manner to them. The rocker 40 is prestressed with the free end in the upward direction (arrow B) by means of two tension springs 50, which are each supported at one end on pins 52 protruding in the outward direction from the rocker plates 44 and at the other end on pins 52' protruding inward from the bearing plates 14, 14'. Fastened on the two bearing plates 14, 14' are U-shaped stops 54, which are open in the downward direction and interact with the end regions of the shank 48 projecting laterally over the rocker plates 44 (FIGS. 3 and 4), in order to prevent a pivoting of the rocker 40 in the counterclockwise sense beyond the rest position shown in FIG. 4. The longitudinal extent of the tension springs 50, running at an acute angle with respect to the line 56 indicated by the dot-dashed lines in FIGS. 1, 4 and 5 and running through the axes of the shaft 26' and of the shank 48, is chosen in such a way as to achieve as flat a spring characteristic as possible with respect to a vertical to the line 56 in the pivoting range of the rocker 40.

In the region between the shaft 26' and the shank 48 there is provided underneath the line 56 a further shank 58, which connects the two rocker plates 44 to each other and on which rollers 60, assigned to the round bands 28, 28', are mounted freely rotatably, in order on the one hand to assist the action of the tension springs 50 and on the other hand to keep the lower sides 46' away from the upper sides 46 when the winding unit 20 is lowered onto the upper sides 46.

A sprocket 66 is mounted on the shaft 26' via a ball bearing 62 (see in particular FIG. 3) and a free-wheel 64, arranged alongside the latter and effective oppositely to the direction of rotation A'. The sprocket 66 is connected via a chain 66', indicated by dot-dashed lines, to a further sprocket 66'', which is mounted in a rotationally fixed manner on a hollow shaft 68. The hollow shaft 68 is provided between the two rocker plates 44 coaxially to the shank 48 and is mounted on the latter via further ball bearings 62'. The rotationally fixed shank 48 and the hollow shaft 68 are coupled to each other via a free-wheel 70, acting in arrow direction A' and consequently also against the free-wheel 64.

A band reel 42, which is in the form of a hollow cylinder and is mounted on the hollow shaft 68 via a sliding sleeve 72, is provided centrally between the two rocker plates 44. On both sides of the band reel 42 there is provided a friction clutch 74, which is connected in a rotationally fixed manner on the one hand to the band reel 42 and on the other hand to the hollow shaft 68.

The band reel 42 has two grooves 76 running around it and spaced apart in the axial direction, in each of which an annular magnet 78 of a magnet device 78' is inset. The magnet device 78' serves for the seizing and taking-over of the outer end of the winding band 21 for winding the winding band 21 onto the band reel 42, with simultaneous unwinding of the roll 20, as to be described in detail further below.

The driving of the band reel 42 and its braking function as follows: if the roller 26, and consequently the shaft 26', are driven in direction of rotation A', the sprocket 66 is coupled in a rotationally fixed manner to the shaft 26', via the ineffective free-wheel 64. Consequently, due to the connection via the chain 66' and the sprocket 66'', the hollow shaft 68 rotates in the same rotational sense A' as the shaft 26. Attention should be paid here that the two sprockets 66, 66'' are coordinated with each other in such a way that the uninfluenced circumferential speed of the empty band reel 42 is equally great or greater than the circumferential speed of the roller 26, which of course coincides with the speed of the round bands 28, 28'. The rotation of the hollow shaft 68 in arrow direction A' is transferred via the friction clutches 74 to the band reel 42, the latter rotating at a slower speed with respect to the hollow shaft 68 the more winding band 21 is wound-up on the band reel 42. The slip between the band reel 42 and the hollow shaft 68 is taken up by the friction clutch, keeping the winding band 21 tensioned.

If, on the other hand, the roller 26 is driven oppositely to arrow direction A', the free-wheel 64 acts, which has the result that no drive force is transferred from the roller 26 to the hollow shaft 68. At the same time, the free-wheel 70 prevents a rotation of the hollow shaft 68 oppositely in arrow direction A'. If, under these conditions, a tensile force which is greater than the force of the friction clutches 74 is exerted on the winding band 21 wound-up on the band reel 42, winding band 21 is unwound under tension from the band reel 42.

Figure 2:
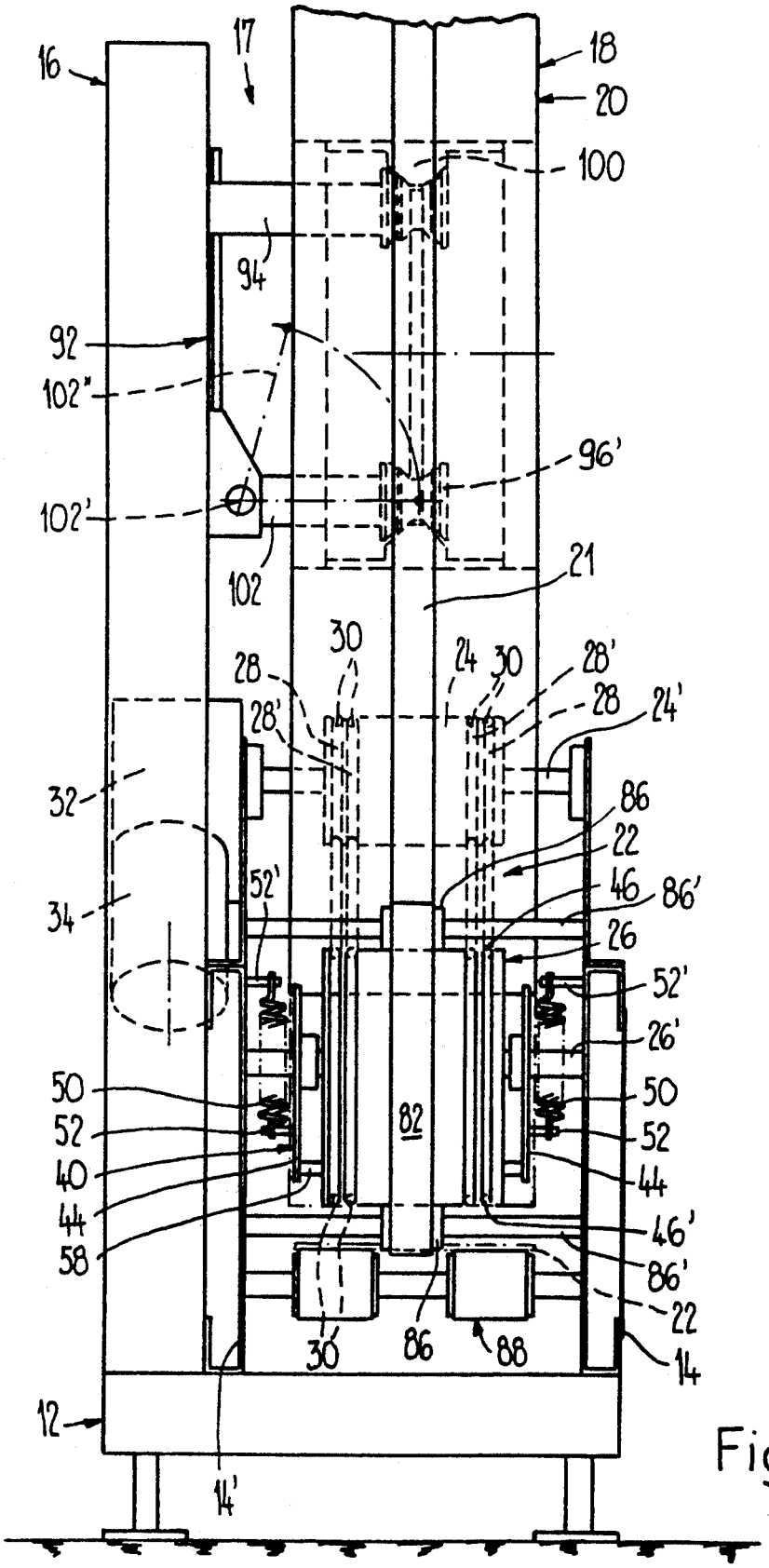

Between the two inner round bands 28', the roller 26 is wrapped around by approximately 180° by a deflection band 82, in order to deflect around the roller 26 the printing products 22 unwound from the winding unit 18 and conveyed away in unwinding direction A onto the upper side 46. The side of the printing products 22 which lies uppermost ahead of the roller 26, seen in conveying direction, lies underneath after the roller 26. The rollers around which the deflection band 82 is led are denoted by 86. They are support via spindles 86' (compare in particular FIG. 2) on the bearing plates 14, 14'. Underneath the conveyor belt arrangement 23 there is provided a removal conveyor 88, which is likewise designed as a belt conveyor and the conveying direction of which runs oppositely to the unwinding direction A, in order to convey the printing products 22 deflected around the roller 26 away in arrow direction C. For this purpose, the removal conveyor 88 directly adjoins the effective conveying end of the deflection band 82. However, it is also conceivable not to deflect the unwound printing products 22 around the roller 26 but to convey them away in arrow direction D, in extension of the upper side 46 of the conveyor belt arrangement 23. For this purpose, instead of the deflection band 82, a removal conveyor belt 90, indicated by dot-dashed lines, is provided, which is led around the roller 26 between the inner round bands 28'.

The bearing arrangement 17 for the winding unit 18 has a carriage or car 92, mounted displaceably in the vertical direction on the guide column 16. Said carriage or car is vertically adjustable via a lifting element, for example a spindle drive, as described in EP-A1 0 281 790, which corresponds to U.S. Pat. No. 4,898,336, or by means of a cable or chain drive. Two extension arms 94 running parallel to each other and arranged at the same height project from the carriage or car 92 in the horizontal direction, at each of the free ends of which a carrying roller 96 is mounted freely rotatably. On the carrying rollers 96, the winding core 19 carrying the roll 20 is mounted freely rotatably, as is shown in particular in FIGS. 1 and 2. The winding core 19 is designed essentially in the form of a hollow cylinder and has a web 100, which runs around the outside, projecting inward, and which is designed in cross-section essentially in the form of a V. The carrying rollers 96 have an essentially corresponding V-shaped profile, in order to keep in the axial direction the winding core 19 set down thereupon. Provided in the center between the two extension arms 94 and underneath them there is a pressing arm 102, which is mounted on the carriage or car 92 pivotally about a horizontal axis 102' and at the free end of which a pressing roller 96' is mounted freely rotatably. In the pressing position, the pressing arm 102 runs essentially parallel to the extension arms 94 and the pressing roller 96' likewise bears against the web 100 and presses the winding core 19 against the carrying rollers 96. As a result, the winding core 19 is prevented from lifting off the carrying rollers 96 even when the winding unit 18 has been set down on the conveyor belt arrangement 23 or the empty winding core 19 bears against the conveyor belt arrangement 23, as revealed by FIGS. 1 and 2 or 5, respectively. From the pressing position, the pressing arm 102 can be pivoted back upward into the rest position 102'', indicated by dot-dashed lines in FIG. 2, in order to be able to lift the empty winding core 19 off the carrying rollers 96, or to permit the depositing of a winding unit 18 onto the carrying rollers 96.

During the unwinding operation, the position of the carriage or car 92 is controlled in such a way that the roll 20 is always wrapped partly around by the upper side 46 of the conveyor belt arrangement 23 and, to avoid slip between the roll 20 and the round bands 28, 28', bears against the latter with a desired force. For this purpose, it is conceivable to provide sensors, in order to monitor the sag of the round bands 28, 28' or the lower end of the winding unit 18 and to lower the carriage or car 92 accordingly, as is described for example in EP-A1 0 281 790, which corresponds to U.S. Pat. No. 4,898,336. During the unwinding of the printing products 22 from the winding unit 18, the diameter of the roll 20 decreases constantly and ultimately, due to the corresponding lowering of the carriage or car 92, the empty winding core 19 bears against the round bands 28, 28', as is indicated by dot-dashed lines in FIG. 1.

The roll 20 is held together by the tensioned winding band 21. The inner end (not shown) of the winding band 21 is fastened to the winding core 19 and, on the outside, the winding band 21 wraps around the roll 20.

Figure 1:
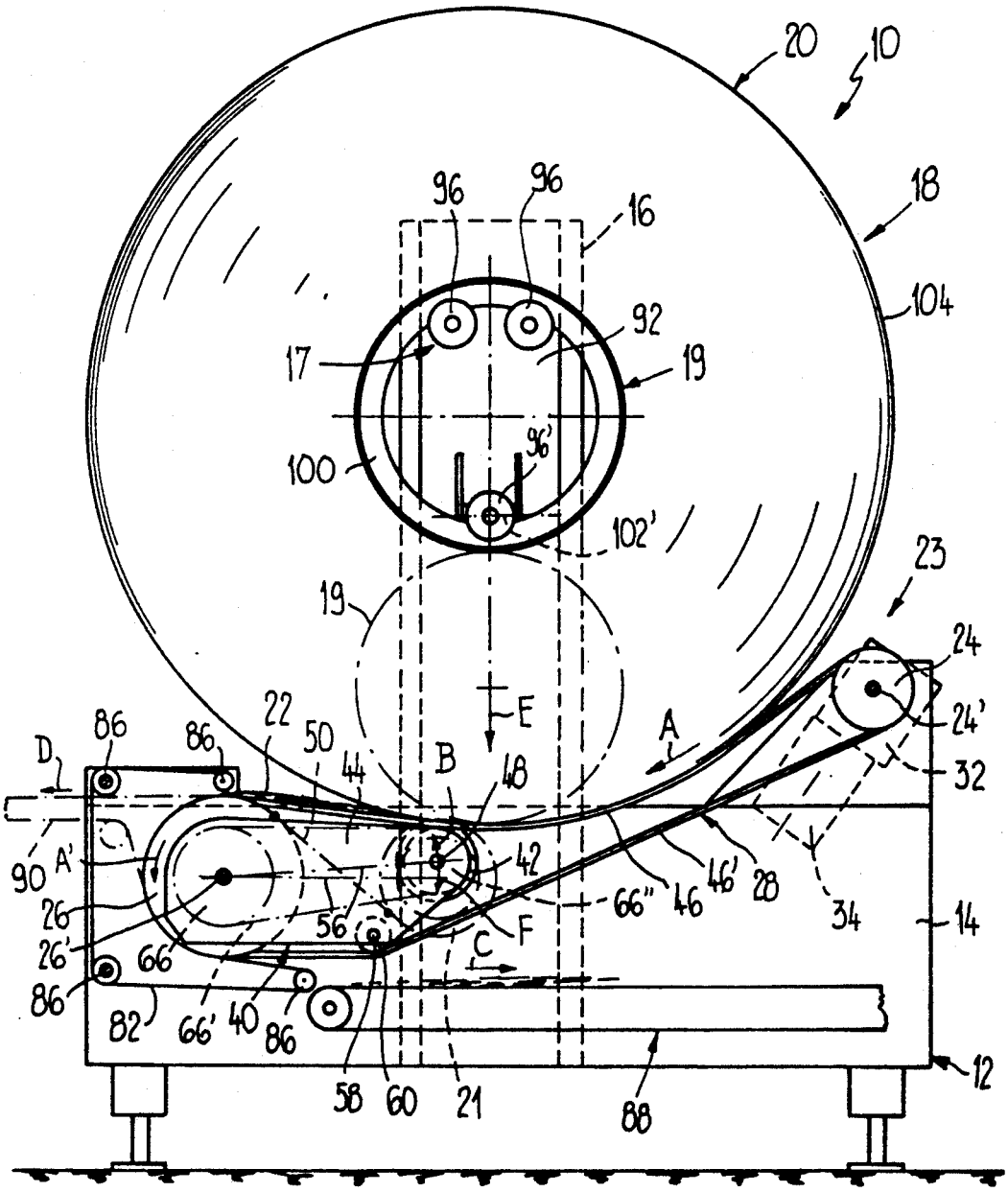
FIGS. 1 and 2 show an unwinding apparatus in elevation and side view, respectively.

Between the two inner round bands 28' runs the winding band 21, which during unwinding from the winding unit 18 is wound onto the band reel 42. During unwinding, the band reel 42, or the winding band 21 already wound-up on it, bears against the circumference 104 of the roll 20 at the section of the winding band 21 wrapping around the roll 20. Due to the increase in the thickness of the band reel 42 with the winding band 21 wound-up on it, the rocker 40 is pivoted counterclockwise against the force of the tension springs 50. In FIG. 1, the position of the empty band reel 42 is indicated by solid lines and the position of the full band reel 42 is indicated by dot-dashed lines.

Figure 4:
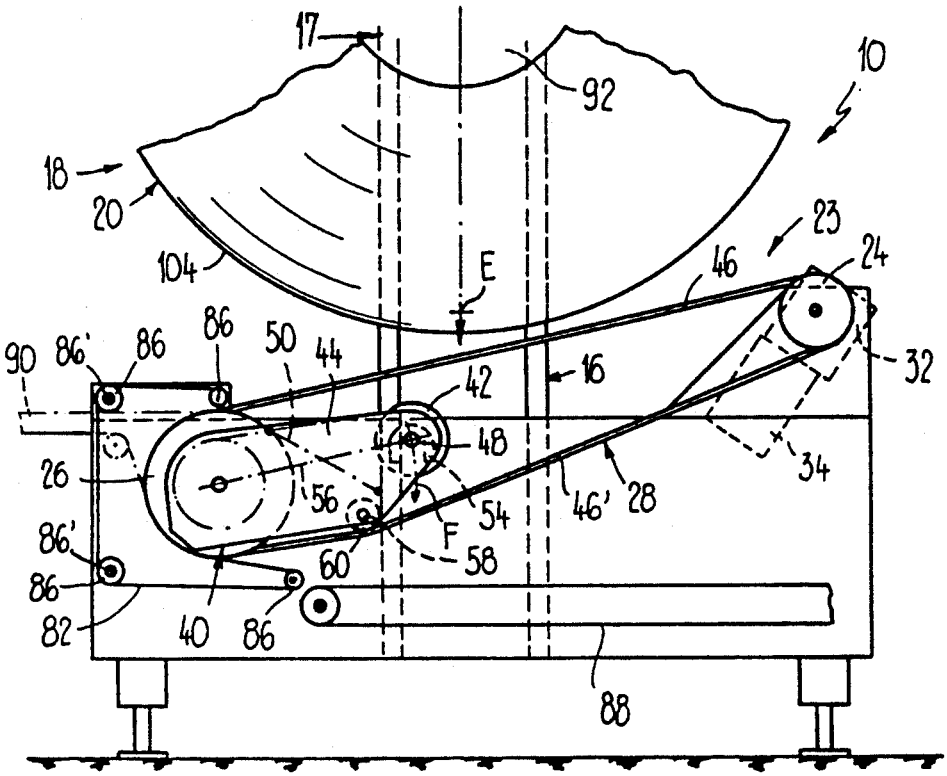
FIGS. 4 and 5 show the unwinding apparatus of FIG. 1 before the beginning of the unwinding operation and during winding-back of the winding band, respectively.

FIG. 4 shows part of the unwinding apparatus 10, the carriage or car 92 being located in its upper end position, so that the circumference 104 of the roll 20 is located above the upper side 46 of the round bands 28, 28', away from them. Due to the force of the tension springs 50, the rocker 40 is kept in its position of rest, in which the shank 48 bears against the stops 54. The lowering of the winding unit 18 for unwinding the printing products 22 is indicated by the arrow E. The arrow F indicates the clockwise pivoting of the rocker 40 during lowering of the winding unit 20 or during increasing of the diameter due to winding of the winding band 21 onto the band reel 42.

After complete unwinding and conveying away of the printing products 22, the winding band 21 unwound from the winding core 19 and wound onto the band reel 42 is wound back again onto the winding core 19. For this purpose, the carriage or car 92 is kept in its lower end position, shown in FIG. 5, as a result of which the empty winding core 19 is wrapped partly around by the round bands 28, 28' and in which position the conveyor belt arrangement 23, and consequently the winding core 19, are driven by rotational direction reversal of the reversing gear 32 in arrow direction G (opposite to arrow direction A).

Figure 6:
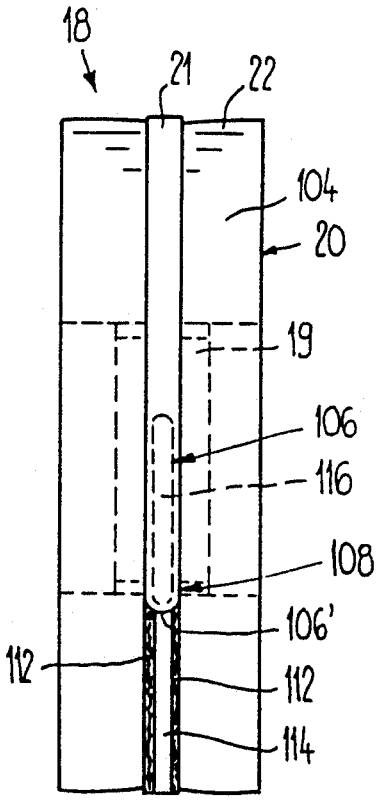
FIG. 6 shows a winding unit in side view.
Figure 7:
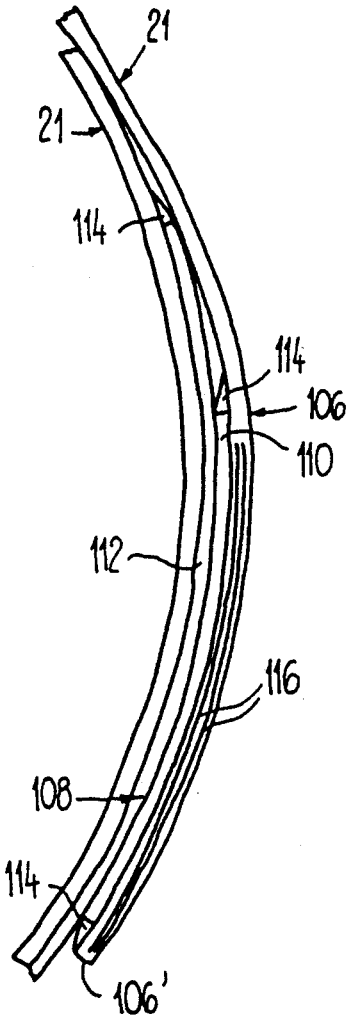
FIG. 7 shows an enlargement of the area of the closure of the winding band of FIG. 6.

FIG. 6 shows a complete winding unit 18. The essentially cylindrical winding core 19 carries the roll 20 wound-up on it, which consists of the printing products 22, wound-up in imbricated formation together with the tensioned winding band 21. The winding band 21 runs around the roll 20 and its outer end region 106 is firmly held by means of a touch-and-close fastener 108 on the section of the winding band 21 wrapping completely around the roll 20. The winding band 21 has at its end region 106 on the side facing the winding core 19 a hook pile 110, as is shown enlarged in FIG. 7. This hook pile 110 interacts with a loop pile 112, which extends on the side of the winding band 21 facing away from the winding core 19 over a length which permits a closing of the touch-and-close fastener 108 irrespective of the size of the roll 20. The hook pile 110 and loop pile 112 are arranged in two lateral strips on the winding band 21 and between them there is a spacer 114. The exact construction and mode of operation of the touch-and-close fastener 108 are described at length in EP-A1 0 310 784, which corresponds to U.S. patent application Ser. No. 07/585,033.

Arranged on the winding band 21 in its end region 106 there are a plurality of very thin iron platelets 116, lying one on top of the other, which are intended for interaction with the magnet device 78 of the band reel 42. The iron platelets 116 may be inset in the end region 106 of the winding band 21, or fastened on the outside of the winding band 21. Since the iron platelets 116 are very thin, the flexibility of the winding band 21 is not impaired. The iron platelets 116 acts as armatures and are attracted by the magnets 78 and held on the band reel 42.

Figure 5:
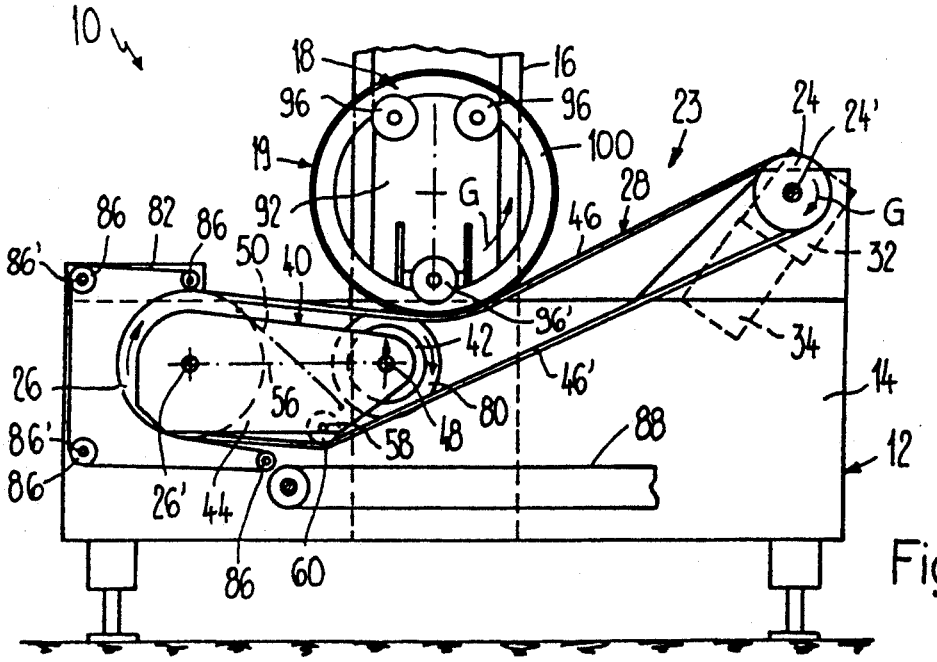

The unwinding apparatus 10 functions as follows: for mounting a winding unit 18 on the bearing arrangement 17, the carriage or car 92 is raised in to the upper end position, shown in FIG. 4, and the pressing arm 102 is pivoted back into the rest position 102". Then, a winding unit 18 is set down, for example by means of a stacking vehicle, on the two carrying rollers 96 with the winding core 19. Subsequently, the pressing arm 102 is pivoted into the pressing position, in order to keep the winding core 19 in contact with the carrying rollers 96 under all conditions. For the unwinding of the printing products 22, the carriage or car 92 is lowered, until the roll 20 is circumferentially partly wrapped around by the elastic round bands 28, 28', as FIG. 1 shows. The band reel 42 thereby comes into contact with the circumference 104 of the roll 20 at the winding band 21. The driving of the round bands 28, 28' in unwinding direction A by the drive motor 34 has the effect that the winding unit 18 is driven clockwise without slip with respect to the round bands 28, 28'. If the winding band 21 then runs with its outer end 106' onto the band reel 42, it is seized and taken over onto the iron platelets 116 of the band reel 42, acting as armatures, due to the magnetic force of attraction of the magnet device 78'. When rotating further in arrow direction A, the touch-and-close fastener 108 is consequently opened by a peeling-like detaching of the hook pile 110 from the loop pile 112, due to the winding up of the end region 106 of the winding band 21 onto the band reel 42. As soon as the band reel 42 has seized the winding band 21, the circumferential speed of the band reel 42 corresponds essentially to the circumferential speed of the winding unit 18, the friction clutches 74 ensuring that the winding band 21 is continuously under a predetermined tension. The winding unit 18 is consequently braked by the round bands 28, 28' against the tensile force exerted on the winding unit 18 by the band reel 42 via the winding band 21. For seizing and taking over the outer winding band end 106', the speed of the conveyor belt arrangement 23 is kept low, and consequently so too is the circumferential speed of the winding unit 18 and of the band reel 42. As soon as approximately two revolutions have been wound from the winding band 21 onto the band reel 42, the speed can be increased in arrow direction A. During the course of the unwinding operation, the printing products 22, arranged in imbricated formation, can then be conveyed away, being detached from the roll 20 and resting on the round bands 28, 28'. The printing products 22 are thereby deflected around the roller 26 and delivered to the removal conveyor 88. Attention must be paid that the band reel 42, or the winding band 21 wound up on it, bears against the circumference 104 of the roll 20 within that region which is wrapped around by the round bands 28, 28'. The printing products 22 are consequently kept clamped between the winding unit 18 and the round bands 28, 28' during detaching of the winding band 21 from it. So as soon as the last printing products 22 unwound from the roll 20 have been transferred to the removal conveyor 88, the round bands 28, 28' are driven oppositely to arrow direction A in arrow direction G, as FIG. 5 shows, by changing the driving direction by means of the reversing gear 32. The winding band 21 is thereby wound back from the band reel 42 onto the outside of the empty winding core 19. This takes place again under tension, since the hollow shaft 68 is prevented by the ineffective freewheel 70 from rotating in the unwinding sense of the band reel 42 (opposite to arrow direction A') and the band reel 42 is braked by the friction clutches 74. Since the band reel 42, prestressed under the force of the tension springs 50 against the winding core 19, bears against the latter or against the winding band 21 already wound-up on it during winding-back of the winding band 21 onto the winding core 19 as well, at the end of the winding-back operation the touch-and-close fastener 108 is automatically and independently closed again and the end region 106 of the winding band 21 is detached from the band reel 42 against the force of the magnet device 78'. Finally, the carriage or car 92 is preferably raised into the upper end position, in order to lift the winding core 19 off the round bands 28, 28'. Once the pressing arm 102 has been pivoted back into the rest position 102', the empty winding core 19, with the winding band 21 wound-up on it, can be lifted off the bearing arrangement 17. The unwinding apparatus 10 is then ready to receive a new winding unit 18.

It is to be appreciated that it is not absolutely necessary that the band reel 42 bears against the circumference 104 of the roll 20 or against the circumference of the winding core 19 during the entire unwinding operation and during the entire winding-back of the winding band 21 onto the winding core 19. For instance, it is only necessary that the band reel 42 bears against the circumference 104 for seizing and taking over the outer winding band end 106', and, during the winding-back of the winding band 21 onto the empty winding core 19, is pressed in the direction toward the winding core 19 at least for closing the touch-and-close fastener 108.

It is also conceivable that the band reel is designed as a suction roller, in order to seize and take over the outer winding band end. Thus, it is also conceivable that the band reel has an adhesive surface instead of the magnet device 78'. It goes without saying that the winding band does not necessarily have to be equipped with a touch-and-close fastener. It is also possible for the end region of the winding band to be kept on the circumference of the roll by means of magnetic or adhesive means.

It goes without saying that it is also conceivable to drive the winding unit from the winding core and to lead the printing products away via a, for example pivotally mounted, belt conveyor which is positioned against the roll. In any case, however, the band reel bears directly against the roll circumference at the winding band for seizing and taking over the outer winding band end.

Instead of printing products, any other flexible sheet-like structures may also be provided. Furthermore, it is also not necessary that these sheet-like structures or the printing products are would up in imbricated formation.

I claim:

1. In an apparatus for unwinding flexible sheet-like structures from a winding unit, wherein the winding unit comprises a plurality of flexible sheet-like structures would up together with a winding band onto a winding core to form a roll, and wherein the apparatus comprises: a bearing arrangement for rotatably supporting the winding unit, a belt conveyor positioned adjacent the winding unit to bear with a first side of the belt conveyor against the roll for conveying away the sheet-like structures during unwinding, and a band reel which is rotatable during unwinding of the sheet-like structures to reel up the winding band as the winding band is unwound from the roll with the sheet-like structure; the improvement comprising:

a supporting arrangement coupled to the band reel to position the band reel against a circumferential portion of the roll in alignment with the winding band; and means, mounted on the band reel, for seizing and taking up and end of the winding band.

2. The apparatus as claimed in claim 1, wherein the belt conveyor wraps partly around the winding unit, and wherein the apparatus further comprises means for driving the belt conveyor and thereby the winding unit.

3. The apparatus as claimed in claim 2, wherein the winding core is mounted freely rotatably on the bearing arrangement, and wherein the roll bears with a predetermined force against the belt conveyor.

4. The apparatus as claimed in claim 2, wherein the belt conveyor comprises a plurality of fixed deflection rollers and a plurality of elastic bands led around the fixed deflection rollers, and wherein the bearing arrangement is vertically adjustable.

5. The apparatus as claimed in claim 4, wherein a first one of the deflection rollers is arranged at an effective conveying end of the belt conveyor, and wherein the apparatus comprises an endless deflection belt for deflecting the unwound sheet-like structures partly around said first one of the deflection rollers.

6. The apparatus as claimed in claim 4, wherein the band reel is mounted on a pivotal rocker, wherein the rocker and a first one of the deflection rollers are mounted on a common shaft, and wherein the apparatus further comprises means for drivingly coupling said first one of the deflection rollers to the band reel when the band reel is rotated in a reeling up sense to reel up the winding band.

7. The apparatus as claimed in claim 6, wherein said first one of the deflection rollers is arranged at an effective conveying end of the belt conveyor.

8. The apparatus as claimed in claim 6, wherein the coupling means between said first one of the deflection rollers and the band reel is configured such that the circumferential speed of the band reel is at least as great as the circumferential speed of said first one of the deflection rollers, and wherein the coupling means comprises a slip clutch for keeping the winding band under tension.

9. The apparatus as claimed in claim 8, wherein the slip clutch is connected to the band reel via a first freewheel, effective oppositely to the reeling-up sense of the band reel, and wherein a counteracting second freewheel is provided for supporting the slip clutch during winding of the winding band under tension back onto the empty winding core.

10. The apparatus as claimed in claim 1 further comprising means for biasing the band reel against the roll.

11. The apparatus as claimed in claim 10, wherein the biasing means comprises a pivotal rocker on which the band reel is mounted, and means for biasing the rocker upwardly.

12. The apparatus as claimed in claim 11, wherein the belt conveyor comprises first and second portions, and wherein the rocker is positioned between the first and second portions and is supported by the second portion.

13. The apparatus as claimed in claim 1, wherein the seizing means comprises a magnetic device, and wherein the winding band comprises on an outer end region thereof an armature part for the automatic seizing and taking-up of the end region of the winding band by the band reel when running past the latter.

14. The apparatus as claimed in claim 13, wherein the armature part comprises a plurality of thin iron platelets lying one on top of the other.

15. The apparatus as claimed in claim 14, wherein the winding band comprises a touch-and-close fastener for firmly holding the winding band around the roll, which fastener can be released by the seizing of the outer band end and winding of the winding band onto the band reel.

16. The apparatus of claim 1, wherein the flexible sheet-like structures comprise printing products in imbricated formation.

* * * * *

UNITED STATES PATENT AND TRADEMARK OFFICE

CERTIFICATE OF CORRECTION

PATENT NO. : 5,158,242
DATED : October 27, 1992
INVENTOR(S) : Werner Honegger

It is certified that error appears in the above-indentified patent and that said Letters Patent is hereby corrected as shown below:

Column 10, claim 1, line 1, delete "would" and substitute therefor--wound--.

Column 10, claim 1, line 17, before "end" delete "and" and substitute therefor --an--.

Signed and Sealed this

Twenty-sixth Day of April, 1994

*Attest:*

Bruce Lehman

BRUCE LEHMAN

*Attesting Officer*

*Commissioner of Patents and Trademarks*